United States Patent [19]

Hull

[11] Patent Number: 4,685,233

[45] Date of Patent: Aug. 11, 1987

[54] PORTABLE YARD SIGN

[76] Inventor: Jack W. Hull, 24476 Via Secreto, El Toro, Calif. 92630

[21] Appl. No.: 715,406

[22] Filed: Mar. 25, 1985

[51] Int. Cl.[4] ..... G09F 15/00

[52] U.S. Cl. ..... 40/607; 40/605

[58] Field of Search ..... 40/607, 606, 611, 605, 40/602; 52/239, 775

[56] References Cited

U.S. PATENT DOCUMENTS

| | | | |
|---|---|---|---|
| 4,334,374 | 6/1982 | Spamer et al. | 40/606 |
| 4,378,650 | 4/1983 | Ottoson | 40/607 |
| 4,408,407 | 10/1983 | Bloom et al. | 40/607 |
| 4,516,344 | 5/1985 | Seely | 40/602 |
| 4,548,377 | 10/1985 | Huel | 40/607 |

*Primary Examiner*—Robert P. Swiatek
*Assistant Examiner*—Cary E. Stone
*Attorney, Agent, or Firm*—Martin Faier

[57] ABSTRACT

A portable yard sign adapted for easy storage, transport and assembly, which is simple to install and remove from a soil bed, without special equipment, and which consists of a rigid upright post having a longitudinal slot extending downwardly from its top edge, and a main sign panel having a foldable side edge corresponding to and insertable into the slot for securing the panel to the post, the post having on its bottom end a ground stake and foot plate assembly for penetration into the soil bed upon application of foot pressure thereon. The main panel foldable side edge may be formed by scoring an edge of the panel and cutting tabs along the folded edge, or by connecting a hinged member along an edge of the panel. A modified embodiment of the invention may utilize an inverted L shaped post with the slot for receiving an edge of the sign panel formed in the post leg parallel to the ground and the sign panel hanging from the post leg toward the ground.

11 Claims, 9 Drawing Figures

PORTABLE YARD SIGN

BACKGROUND AND SUMMARY OF THE INVENTION

This invention relates to portable yard signs, particularly residential "For Sale" and similar signs of the kind used to inform the public of the availability of a building or the identity of a seller or broker.

Such signs must be easy to store, transport and assemble by a real estate sales person, frequently a woman, without any special tools or equipment. Preferably, the sign must be capable of being handled in a flat condition so that its components may be simply stacked and carried. Assembly should involve only minimal manipulation of the sign components and be without opportunity for misadjustment, and assembly must be simple enough to complete the job quickly at the site. Installation and removal of the sign must also be easily accomplished, preferably with the sign being installed in a yard with just foot pressure by a person of moderate size and strength, and preferably removal must be performed by just rocking the sign and pulling it from the earth, even under severe weather conditions.

Added to the foregoing criteria are the requirements that the sign must be adequately versatile to permit display on its main panel of identification of a selling broker and possibly special features, for example to indicate an open house or that special financing is available, preferably without disturbing the mounting of the sign. More importantly, the sign must withstand wind and weather. Wind must spill from its panel without blowing over the sign. Snow and rain or other adverse weather should not make the sign appear unsightly.

Whether the sign is on display a short time or a matter of months, when it is no longer required, it must be simply removable by a real estate sales person, who can withdraw it from the site and take it apart and store it without much effort and without damaging the sign assembly.

The sign embodying the present invention meets the above criteria. The sign post may be just a length of rigid tubing, with a longitudinal slot formed on its edge from one end thereof, and a ground stake and foot plate assembly secured to its other end. The sign panel is preferably a sheet of plastic such as polyethylene or other similar polymer material which may be suitably decorated and capable of withstanding severe weather conditions. Where there is little danger of warpage under variable weather conditions, the sign panel may be fabricated from a single sheet of material and heat scored on one edge to form a self-hinge; or if moderate warpage is a danger, the panel may be laminated from a plurality of hinged plastic sheets; or if there is severe variance in weather conditions, the panel may have attached to its edge a reinforced hinge member. In either case, one edge of the sign panel is hinged and foldable in the direction of the main body of the sign panel to provide an edge area of greater thickness than the remainder of the panel, and this edge portion is threaded into the channel or tubular area of the post, with the adjacent area of the panel projecting through the slot and exposed to view.

The plastic sign panel is adequately rigid to extend or hang flag-like from the post, but of sufficient resiliency to allow for windspill when pressures against the sign build up and of adequate memory to return to extended position. The binding of the folded edge is sufficient to hold the sign panel on the post. The folded edge area may be manipulated tightly against the main sign panel body to permit easy insertion into and withdrawal from the tubular area of the post, but once in position the folded edge area is permitted to flex free against the walls of the tubular post binding the sign panel in the post against unintended withdrawal.

Special feature panels may be hung from the main sign panel or fabricated like the main sign panel, with an appropriate lengthening of the sign edge receiving slot on the post. Once the sign panel is assembled on the post, the sign may be mounted by stepping on the foot plate at the bottom end of the post, which forces the ground stake into the soil bed.

Sign panels may be laid flat on one another for easy storage and transport, and are interchangeable on the posts. The entire sign may be assembled without any tools or special equipment, and no special equipment is necessary for installation or removal of such a sign. The sign may be erected and removed without requiring a person of special training or strength.

Such a sign is essentially impervious to weather. The panel will not rot, scratch, rust or become dirty (but is in fact washed after each rain or snow fall). The post may also be fabricated from plastic, or of metal and coated with weather resistant materials. Preferably, the post is closed by a removable cap to finish its free end. The sign is lightweight, portable, and capable of easy assembly and firm anchoring.

OBJECTS AND ADVANTAGES OF THE INVENTION

It is the object of the present invention to provide a portable yard sign of the character referred to.

Another object is to provide a portable yard sign having a novel rigid tubular post with a slotted edge for removably receiving a sign panel.

Another object is to provide a novel scored foldable hinged sign panel for a portable yard sign.

Another object is to provide a novel slotted post - hinged sign panel assembly for a portable yard sign.

Another object is to provide a novel hinged edge member having bendable tabs on a sign panel for a portable yard sign.

Another object is to provide a novel reinforced hinged edge member for a sign panel of a portable yard sign.

Another object is to provide a novel laminated sign panel assembly for a portable yard sign.

It is a further object of the present invention to provide a portable yard sign which is simple to assemble and take apart, and to install and remove from a soil bed, all without tools or special knowledge.

It is another object of the present invention to provide a portable yard sign which is simple and inexpensive to manufacture and very efficient in use.

These and other objects of the present invention will become more apparent as this description proceeds, taken in conjunction with the accompanying drawings.

DESCRIPTION OF PREFERRED EMBODIMENTS

Figure 1:
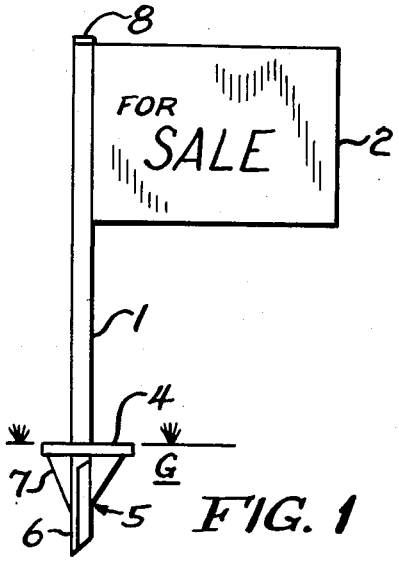
FIG. 1 is a side elevational view of the assembled yard sign embodying the present invention.

With reference to the sign shown in FIGS. 1-4, the device consists of an upright tubular post 1, from which a main sign panel 2 is extended, secured in slot 3 formed in the post. On the bottom of post 1 is an assembly for mounting the sign in a soil bed G which consists of foot plate 4, from which depends stake assembly 5, comprising sharpened stake 6 and a reinforcement 7 connected to foot plate 4. Plug 8 may be inserted into the open upper end of post 1.

Figure 3:
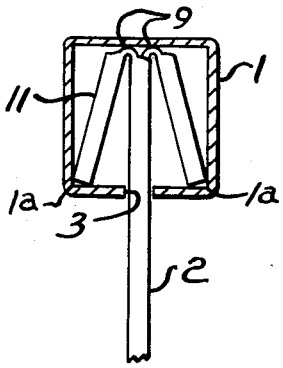
FIG. 3 is a cross-sectional view of the post and sign panel assembly taken on line 3—3 of FIG. 2.
Figure 2:
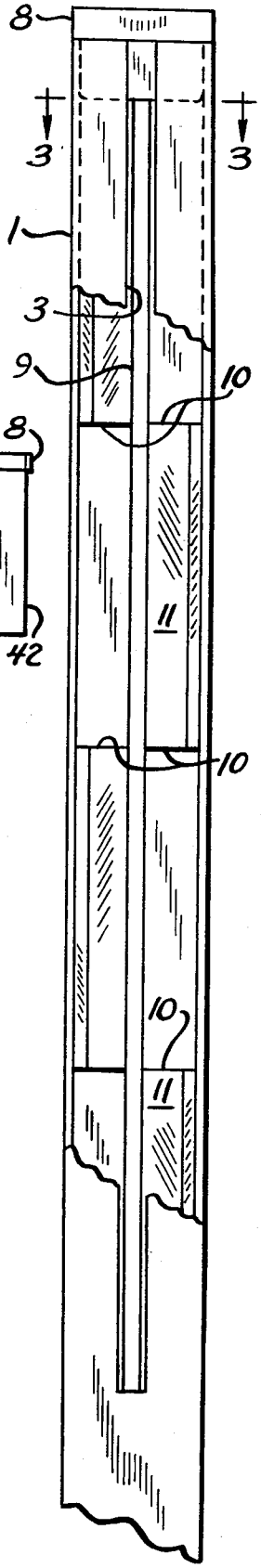
FIG. 2 is an enlarged elevational view, with parts broken away, partially in section, of the post and sign panel assembly.
Figure 4:
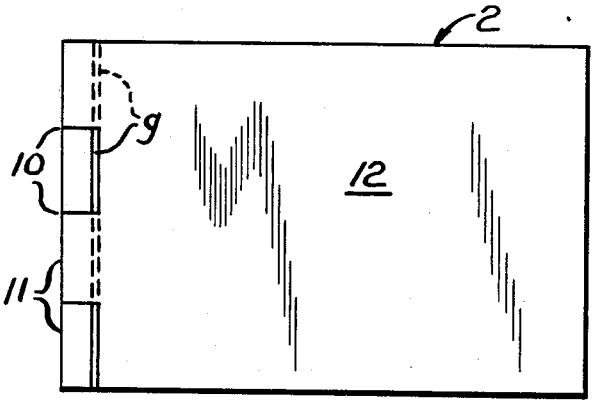
FIG. 4 is a plan view of the sign panel shown in FIGS. 1-3.

As shown in FIGS. 2 and 3, one edge of the panel 2 is scored, as at 9, and may be cut, as at 10, to provide tabs 11, which are dimensioned to bear against the corners 1*a* of the tubular post 1 when allowed to flex free within the channel area. The display area 12 of the sign panel 2 is held flag-like extended from the sign post 1. Preferably, the sign panel 2 is fabricated from a sheet of polyethylene, which may easily be scored and hinged, which can accept suitable decoration, and which resists severe weather conditions.

Figure 5:
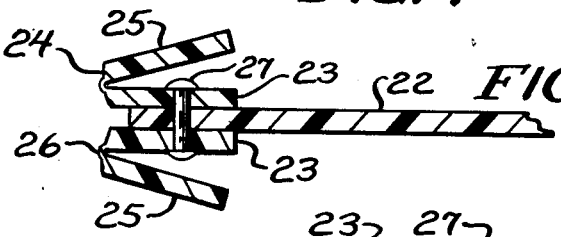
FIG. 5 is a sectional view of a modified sign panel and reinforced hinged member therefor.
Figure 6:
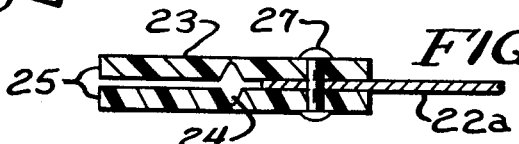
FIG. 6 is a sectional view of a modified sign panel and reinforced hinged member similar to FIG. 5, except before folding and with a modified sign panel.

With reference to FIGS. 5 and 6, the sign panels 22 and 22*a*, respectively, are each secured between opposed reinforcing hinged members 23, which are scored, as at 24, and have portions 25 bent away from the plane of the respective sign panel 22 or 22*a*, at hinges 26. These members 23 may be secured in position by means of a rivet 27 fastened through the sign panel, 22 or 22*a*. The structure shown in FIG. 5 is particularly useful where the sign must withstand many different kinds of weather, such as hot sun or below zero cold, which in many cases can warp polyethylene and other suitable plastic materials for the sign panels. The structure shown in FIG. 6 may be used in many of the circumstances in which a plastic sign panel is used as shown in FIG. 5, but also in conditions where the sign must be decorated in an manner where metal serves as a better sign than plastic.

Figure 7:
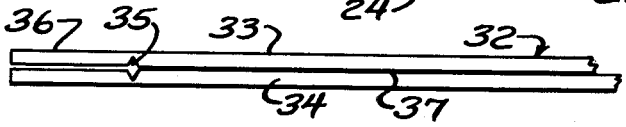
FIG. 7 is a sectional view of a further modified hinged sign panel fabricated from laminated sheets.
Figure 8:
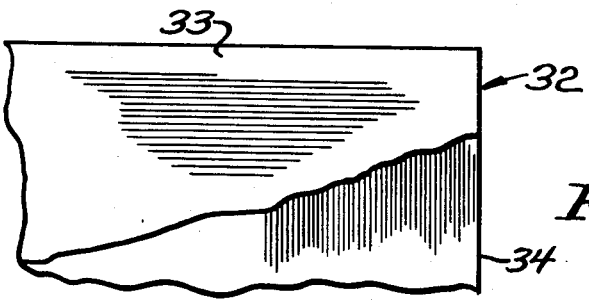
FIG. 8 is a partial plan view of the FIG. 7 modified panel with a laminated sheet partially broken away.

In FIGS. 7 and 8, there is shown a laminated sign panel 32, which is formed from two plastic panels 33 and 34, preferably oriented at right angles to one another, to resist sun warpage. Preferably, the lamination is performed by gluing the faces of the panels together, as at 37. The panels are each scored, as at 35, to form hinges, and the free ends 36 thereof, are bent similarly to the hinge members 23 shown in FIG. 5, so that they will fit within the tubular or channel area of the post 1, as shown in FIG. 3.

Figure 9:
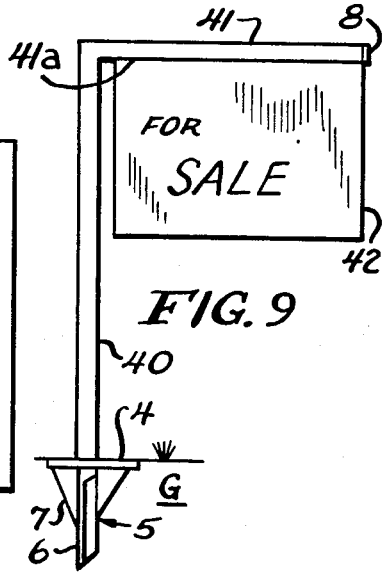
FIG. 9 is a side elevational view similar to FIG. 1, except showing a modified sign post and panel, whereby the post is shaped like an inverted L, the slot is formed on the post leg parallel to the ground and the top sign panel edge is hinged to provide hanging of the sign parallel to the ground.

With reference to FIG. 9, the post is shaped like an inverted L and has a upright leg 40 and a leg 41 extending angularly therefrom which is parallel to the ground G. This leg 41 has on its lower edge 41*a* a slot like slot 3 in FIG. 3, and the sign panel 42 has a folded upper edge for retaining the sign panel hung from the post.

In each panel design, an edge 11, 25 or 36 is bent on a self-hinged member to fit within a corresponding slot 3 of a tubular or channel-like post, so that the thickened edge is lodged within the channel area to resist unintended removal, either by weather stress or other means. Yet, when it is desired to withdraw the sign panel for storage or change in message, the hinged edges must merely be brought together against the sign panel and the post cap removed, thus allowing for easy withdrawal by sliding the sign out of the slot.

While preferred embodiments of the invention have been shown and described in considerable detail, it is not intended that the invention should be limited to the exact construction disclosed, as many modifications may be made in the structures without departing from the spirit or scope of the invention. Accordingly, it is desired that this invention should not be limited, except as limited by the appended claims.

I claim:

1. In a portable yard sign, a rigid upstanding channel-like post, a slot on one side of and extending downwardly from the top edge of said post, a sign panel, a foldable plastic member on a side edge of said panel corresponding in length to and insertable into said post slot, said member having formed therein hinge means and portions foldable toward said sign panel adapted for seating within said channel-like post for securing said sign panel in and extending outwardly from said post, said foldable portions being formed on opposed faces of said sign panel.

2. In the portable sign recited in claim 1, wherein said channel-like post has corners formed by its side walls and slotted wall for securing said sign panel within said slot when said foldable portions are flexed free of said sign panel.

3. In the portable sign recited in claim 1, wherein a foot plate and stake assembly is secured on the bottom edge of said post.

4. In a portable yard sign, a rigid upstanding channel-like post, a slot on one side of and extending downwardly from the top edge of said post, a sign panel, a foldable plastic member on and comprising an edge of said panel corresponding in length to and insertable into said post slot, said member having formed therein hinge means and portions foldable toward said sign panel adapted for seating within said channel-like post for securing said edge having a score across said sign panel forming said hinge means and foldable portion.

5. In the portable sign recited in claim 4, wherein said foldable portion is cut from and perpendicular to said score to form tabs foldable in opposed directions.

6. In a poratable yard sign, a rigid upstanding channel-like post, a slot on one side of and extending downwardly from the top edge of said post, a sign panel, a foldable plastic member on an edge of said panel corresponding in length to and insertable into said post slot, said member having formed therein hinge means and portions foldable toward said sign panel adapted for seating within said channel-like post for securing said sign panel in and extending outwardly from said post, said foldable member comprising a length of material secured to said sign panel, a second length of material being secured to said sign panel on a face opposed to said first length of material.

7. In the portable sign recited in claim 6, wherein both of said lengths of material have a score defining like hinge means and foldable portions.

8. In the portable sign recited in claim 7, wherein said scores are disposed in face to face relation and said foldable portions are hinged to bend in opposite directions.

9. In the portable sign recited in claim 6, wherein said length of material and said sign panel are each fabricated from a thermoplastic substance.

10. In the portable sign recited in claim 9, wherein said thermoplastic substances are dissimilar.

11. In the portable sign recited in claim 6, wherein said sign panel is fabricated from metal.

* * * * *